United States Patent [19]

Bégout et al.

[11] Patent Number: 4,929,962

[45] Date of Patent: May 29, 1990

[54] FEED HORN FOR A TELECOMMUNICATIONS ANTENNA

[75] Inventors: Eric Bégout, Nogent Sur Marne; Alain Bourgeois, Eaubonne; Raymond Gueuret, Nanterre; Pascal Lapeyre, Ermont, all of France

[73] Assignee: Societe Anonyme dite: Alcatel Thomson Faisceaux Hertiziens, Levallois Perret Cedex, France

[21] Appl. No.: 130,593

[22] Filed: Dec. 9, 1987

[30] Foreign Application Priority Data

Dec. 9, 1986 [FR] France ..... 86 17210

[51] Int. Cl.[5] ..... H01Q 13/00

[52] U.S. Cl. ..... 343/786; 343/772

[58] Field of Search ..... 343/786, 772

[56] References Cited

U.S. PATENT DOCUMENTS

| | | | |
|---|---|---|---|
| 2,960,671 | 11/1960 | Ohm | 333/35 |
| 3,553,707 | 1/1971 | Yang et al. | 343/786 |
| 3,662,393 | 5/1972 | Cohn | 343/786 |
| 3,906,508 | 9/1975 | Foldes | 343/786 |
| 3,928,825 | 12/1975 | Kaffenberger et al. | 333/21 R |
| 3,985,851 | 10/1976 | Macturk | 343/786 |
| 4,112,432 | 9/1978 | Wong et al. | 343/786 |
| 4,210,915 | 7/1980 | Kienberger et al. | 343/772 |
| 4,380,014 | 4/1983 | Howard | 343/772 |
| 4,578,681 | 3/1986 | Howard | 343/786 |
| 4,731,616 | 3/1988 | Fulton et al. | 343/786 |

FOREIGN PATENT DOCUMENTS

| | | | |
|---|---|---|---|
| 0136818 | 4/1985 | European Pat. Off. | 343/772 |
| 0145292 | 6/1985 | European Pat. Off. . | |
| 2096684 | 2/1972 | France . | |
| 0154901 | 9/1983 | Japan | 343/786 |
| 2150358 | 6/1985 | United Kingdom . | |

OTHER PUBLICATIONS

P. J. B. Clarricoats, "Some Recent Advances in Microwave Reflector Antennas", Proc. IEE, vol. 126, No. 1, Jan. 1979, pp. 9–25.

*Primary Examiner*—William L. Sikes
*Assistant Examiner*—Robert E. Wise
*Attorney, Agent, or Firm*—Sughrue, Mion, Zinn, Macpeak & Seas

[57] ABSTRACT

A feed horn comprising a radiating portion having a circular aperture, a transition formed by progressively varying waveguide sections and a flange which provides a coupling with a rectangular waveguide is fabricated from moldable material and designed to be fixed in a support. The radiating portion of the horn is formed by a cylindrical flange having at least two concentric grooves which form two traps.

13 Claims, 1 Drawing Sheet

FEED HORN FOR A TELECOMMUNICATIONS ANTENNA

BACKGROUND OF THE INVENTION

1. Field of the Invention

The present invention relates to a source of illumination or so-called feed horn for a telecommunications antenna.

2. Description of the Prior Art

The development of telecommunications, especially by satellite (reception and transmission of data, TV reception) calls for antennas which have excellent performance.

In order to ensure this overall performance, it is necessary to provide a source of illumination or feed horn which has symmetry of revolution and offers good polarization characteristics.

Nevertheless, the steadily increasing number of potential users dictates the need to design products which involve very low fabrication costs.

Conventional sources of illumination offering radiation patterns with good symmetry of revolution of the corrugated horn type suffer from the disadvantage of being very costly to manufacture.

Conventional trap-type feed horns offer the advantage or being more economical to construct but have low directivity which is nevertheless sufficient to illuminate a reflector of the parabolic type. These feed horns are composed of parts having an axis of symmetry (circular waveguide, trap, and so on) and must be fed by a standard rectangular waveguide. This feed is performed by means of a transition which may be either continuous or stepped.

Thus a French patent Application granted under No 2,096,684 describes a device for coupling a circular waveguide with a parabolic reflector of revolution which comprises a circular waveguide excited in the $TE_{11}$ mode, a first end of this waveguide being located at the focus of said reflector and the other end being connected to a rectangular waveguide. An incomplete cylindrical annular cavity surrounds the first end of the waveguide. A transition element formed by a series of waveguide sections having progressively varying shapes and dimensions establishes a coupling with the rectangular waveguide.

However, a continuous transition must be of appreciable length in order to obtain good matching characteristics. A stepped transition as described in the patent Application cited earlier permits a reduction in length but is difficult to fabricate in accordance with low-cost technologies.

The object of the present invention is to overcome these disadvantages.

SUMMARY OF THE INVENTION

The invention accordingly proposes a telecommunications-antenna illumination source designated as a feed horn and comprising :

- a radiating portion having a circular aperture ;
- a transition formed by progressively varying waveguide sections ;
- a flange which provides a coupling with a rectangular waveguide.

Said feed horn is distinguished by the fact that it is fabricated from moldable material, that the radiating portion is formed by a cylindrical flange provided with at least two concentric grooves forming two traps and that said feed horn is provided with means for fixing in a support.

The great advantage of a feed horn of this type is that it is a broad-band source (10.7–12.75 GHz) which is designed to illuminate an antenna reflector while achieving radio propagation performances which meet very high standards as well as mechanical and climatic performances which satisfy very exacting requirements, and the industrial development of which makes use of economical technologies. The invention in fact makes it possible to fabricate by molding a part which is wholly integrated and is therefore of far lower cost than feed horns of the prior art which were obtained by electroforming or spark-erosion machining processes.

DETAILED DESCRIPTION OF THE INVENTION

Figure 1:
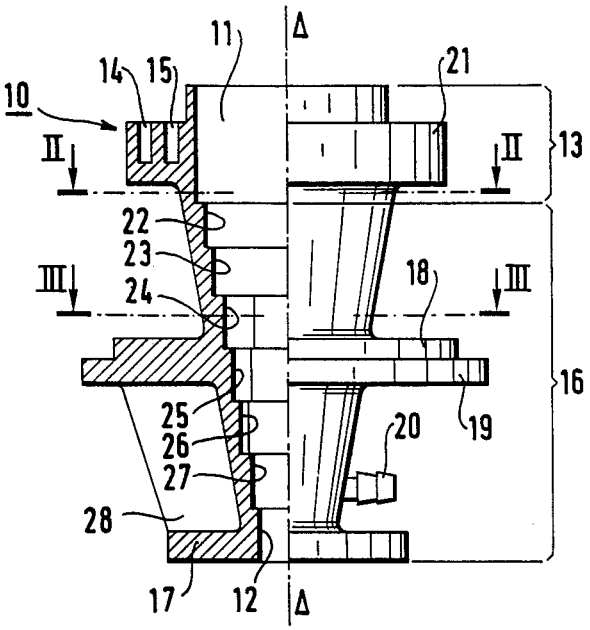
FIG. 1 is a view in half-section and half-elevation of the feed horn in accordance with the invention.
Figure 2:
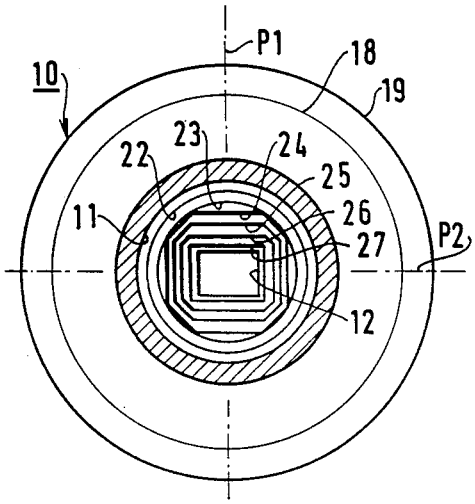
FIG. 2 is a view in cross-section of the feed horn in accordance with the invention, this view being taken along the plane II—II of FIG. 1.
Figure 3:
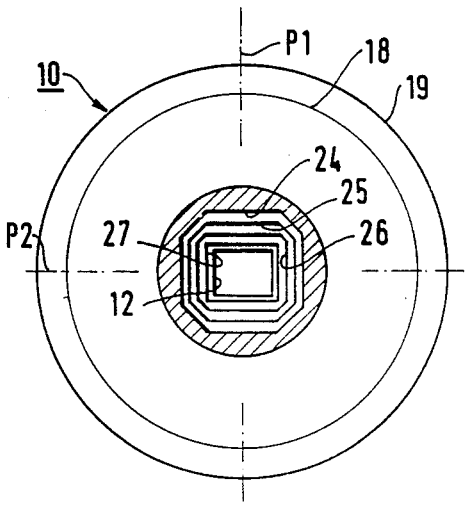
FIG. 3 is a view in cross-section of the feed horn in accordance with the invention, this view being taken along the plane III—III of FIG. 1.

The feed horn 10 in accordance with the invention is a waveguide having a circular aperture 11 at its first end and a rectangular aperture 12 at its other end.

The horn comprises :

- a radiating portion 13 provided with two traps 14 and 15 and with the aperture 11, the diameter of which determines the operating frequency ;
- a transition 16 between said portion 13 and a standard rectangular waveguide (not shown in the figure) which provides a coupling with a microwave head ;
- a flange 17 which terminates said transition 16 and provides a coupling with said rectangular waveguide.

In order to permit a more precise description, the feed horn in accordance with the invention will now be considered from its first end to its second end.

Externally, this feed horn 10 includes :

- a cylindrical flange 21 located at a point close to said first end and having an axis which is the axis of symmetry Δ of the feed horn 10, that face of said cylindrical flange which is located nearest the first aperture being provided with two concentric circular grooves 14 and 15 which form the two traps ;
- two concentric cylindrical flanges 18 and 19 which are located in the central portion of the horn 10 and are coaxial with the axis of symmetry Δ of this latter, the function of said cylindrical flanges being to fix the horn 10 in its support ;
- a pressurization nipple 20 ;
- the coupling flange 17 located at the second end of the horn 10.

The internal face of said feed horn 10 has six steps 22, 23, 24, 25, 26 and 27 which are symmetrical with respect to two perpendicular section planes P1 and P2 and which progressively decrease in size from the circular aperture 11 down to the second rectangular end 12.

The aforementioned steps are accordingly arranged as follows :

two first steps 22 and 23 forming circular waveguide sections ;

three steps 24, 25 and 26 forming rectangular waveguide guide sections having rounded corners ;

a last step 27 forming a rectangular waveguide section.

The portion 28 located outside the feed horn corresponds to the point at which material is poured between two forms used in the molding operation.

This feed horn can in fact be fabricated in accordance with a process involving the following steps :

pouring of a moldable material such as, for example, an aluminum alloy or a dielectric material such as an epoxy resin into a mold consisting of two juxtaposed forms ;

drying of this material ;

removal from the mold.

In the event that the moldable material is a dielectric material, this process is followed by a step involving metallization with nickel, for example.

The molding tools are made of special steel, for example. They have a number of movable parts, chief among these being the following :

two symmetrical forms in which the longitudinal junction plane contains the axis Δ of revolution of the feed horn in accordance with the invention ;

a central core in which the male form accurately reproduces the cylindrical waveguide followed by the rectilinear transition.

Depending on the molding process which is adopted, a system for supplying moldable material (aluminum or epoxy resin, for example) permits filling of the part within the molding tools.

A system of movable parts for ejecting the molded part as already known to those skilled in the art makes it possible to extract this part from the molds without any deformation, thus retaining all of its geometrical characteristics.

The invention offers an appreciable advantage in that it does not require any additional machining operations. Moreover, its wave-propagation design concept and method of manufacture are adapted to medium-scale as well as large-scale production and thus permit the achievement of low-cost levels. A further point worthy of mention is that this method of manufacture permits integration of a pressurization nipple without any additional cost.

A protective radome can be fixed on the aperture plane of the circular portion 13. This radome may thus serve to prevent any penetration of runoff water into the horn and also to shut-off the horn when this latter is pressurized.

In one example of construction, the feed horn 10 in accordance with the invention is made up of the following elements :

a circular aperture 11 having a diameter of 1.2 λ surrounded by two traps 14 and 15 having a thickness of 0.085 λ and located behind the aperture, these traps themselves being relatively spaced at a distance of 0.085 λ, where λ is the wavelength corresponding to the center frequency in the useful band (±15 % about the center frequency) ;

a stepped rectilinear transition consisting of two steps in succession forming circular waveguide sections followed by four steps forming rectangular waveguide sections which may have rounded ends (six steps of $\lambda g/4$ with $\lambda_g$=wavelength of guided waves) and in which each step constitutes a portion of waveguide whose cross-section is inscribed within the circle which constitutes the smaller-diameter circular waveguide of the radiating portion.

By way of example, the following are therefore obtained :

a circular aperture 11 having a diameter of 31.5 millimeters;

a rectangular aperture 12 having the following dimensions : 9.9 mm×19.2 mm ;

a length of 76.2 mm.

By virtue of the traps 14 and 15, this feed horn 10 has a wholly symmetrical radiation pattern of the order of − 10 dB at approximately 50° .

A horn of this type has a very good standing-wave ratio (SWR) of the order of 1.07 in respect of frequencies varying between 10.7 and 12.75 GHz, whether said horn is made of metallized epoxy resin or of aluminum.

The invention makes it possible to obtain a radiating source in the form of a highly compact feed horn which can be directly connected to a standard rectangular waveguide. This part can also be fabricated by very economical technological means such as :

molding of aluminum alloy ;

molding of metallizable epoxy resins ;

electroforming with a nondestructible core ;

spark-erosion machining.

Feed horns in accordance with the invention can be fabricated by means of mass-production technologies such as, for example :

precision shell-molding of aluminum alloy ;

epoxy-resin molding and metallization with nickel, for example.

It is readily apparent that the present invention as described in the foregoing with reference to the accompanying drawings has been given solely by way of preferential example and that technically equivalent constituent elements could accordingly be adopted without thereby departing either from the scope or the spirit of the invention.

What is claimed is:

1. A feed horn for a telecommunications antenna, said feed horn being fabricated from a moldable material, said feed horn comprising:

a radiating portion having a circular aperture, said radiating portion being formed by an annular flange provided with a least two concentric grooves forming two traps, said grooves having open ends which are substantially coplanar;

a transition having first and second ends and formed by waveguide sections of progressively varying cross-section, said transition being coupled at said first end to said radiating portion;

a flange surrounding said second end of said transition and which provides a coupling with a rectangular waveguide; and fixing means for fixing said feed horn in a support, said fixing means comprising two concentric cylindrical flanges having different diameters and located in the external central portion of said horn.

2. A feed horn for a telecommunication antenna, said feed horn being fabricated from a moldable material, said feed horn comprising:

a radiating portion having a circular aperture, said radiating portion being formed by an annular flange provided with a least two concentric grooves forming two traps, said grooves having open ends which are substantially coplanar;

a transition having first and second ends and formed by waveguide sections of progressively varying cross-section, said transition being coupled at said first end to said radiating portion and including at least two circular transitions followed by at least two transitions of rectangular shape;

a flange surrounding said second end of said transition and which provides a coupling with a rectangular waveguide; and fixing means for fixing said feed horn in a support.

3. A feed horn for a telecommunications antenna, said feed horn being fabricated from a moldable material, said feed horn comprising:

a radiating portion having a circular aperture, said radiating portion being formed by an annular flange provided with a least two concentric grooves forming two traps, said circular aperture having a diameter of 1.2λ surrounded by two traps having a thickness of 0.085λ and located behind the aperture, said traps themselves being relatively spaced at a distance of 0.085λ, where λ is the wavelength corresponding to a center frequency in the useful band, and wherein the transition comprises successively six steps of $\lambda_g/4$, where $\lambda_g$ is the wavelength of guided waves;

a transition having first and second ends and formed by waveguide sections of progressively varying cross-section, said transition being coupled at said first end to said radiating portion and including at least two circular transitions followed by at least two transitions of rectangular shape;

a flange surrounding said second end of said transition and which provides a coupling with a rectangular waveguide; and fixing means for fixing said feed horn in a support.

4. A feed horn according to claim 3, wherein the transition comprises successively :

two steps forming a circular waveguide section ;

three steps forming a rectangular waveguide section having rounded ends ;

one step forming a rectangular waveguide section.

5. A feed horn according to claim 1, wherein said horn is fabricated from aluminum alloy.

6. A feed horn according to claim 3, wherein said horn is fabricated from dielectric material which has been metallized.

7. A feed horn according to claim 6, wherein said dielectric material is epoxy resin.

8. A feed horn according to claim 6, wherein said horn has been metallized with nickel.

9. A feed horn for a telecommunications antenna, said feed horn being fabricated from a moldable material, said feed horn comprising:

a radiating portion having a circular aperture, said radiating portion being formed by an annular flange provided with a least two concentric grooves forming two traps, said grooves having open ends which are substantially coplanar;

a transition having first and second ends and formed by waveguide sections of progressively varying cross-section, said transition being coupled at said first end to said radiating portion and including at least two circular transitions followed by at least two transitions of rectangular shape with rounded corners followed by at least one transition of rectangular shape with square corners;

a flange surrounding said second end of said transition and which provides a coupling with a rectangular waveguide; and fixing means for fixing said feed horn in a support.

10. A feed horn for a telecommunication antenna, said feed horn being fabricated from a moldable material, said feed horn comprising:

a radiating portion having a circular aperture, said radiating portion being formed by an annular flange provided with a least two concentric grooves forming two traps, said grooves having open ends which are substantially coplanar;

a transition having first and second ends and formed by waveguide sections of progressively varying cross-section, said transition being coupled at said first end to said radiating portion and including at least two circular transitions followed by at least two transitions of rectangular shape with rounded corners followed by at least one transition of rectangular shape with square corners;

a flange surrounding said second end of said transition and which provides a coupling with a rectangular waveguide; and fixing means for fixing said feed horn in a support.

11. A feed horn for a telecommunication antenna, said feed horn being fabricated from a moldable material, said feed horn comprising:

a radiating portion having a circular aperture, said radiating portion being formed by an annular flange provided with a least two concentric grooves forming two traps, said grooves having open ends which are substantially coplanar;

a transition having first and second ends and formed by waveguide sections of progressively varying cross-section, said transition being coupled at said first end to said radiating portion;

a flange surroundings said second end of said transition and which provides a coupling with a rectangular waveguide; and fixing means for fixing said feed horn in a support.

12. A feed horn for a telecommunication antenna, said feed horn being fabricated from a moldable material, said feed horn comprising:

a radiating portion having a circular aperture, said radiating portion being formed by an annular flange provided with a least two concentric grooves forming two traps;

a transition having first and second ends and formed by waveguide sections of progressively varying cross-section, said transition being coupled at said first end to said radiating portion;

a flange surrounding said second end of said transition and which provides a coupling with a rectangular waveguide;

fixing means for fixing said feed horn in a support; and an integrated pressurization nipple.

13. A feed horn according to claim 12, wherein the annular flange of the radiating portion is cylindrical.

* * * * *